United States Patent [19]

Pomonik

[11] 4,422,401

[45] Dec. 27, 1983

[54] RAISED ANCHOR POINT CATENARY MOORING SYSTEM

[75] Inventor: George M. Pomonik, Van Nuys, Calif.

[73] Assignee: Amtel, Inc., Providence, R.I.

[21] Appl. No.: 168,050

[22] Filed: Jul. 14, 1980

[51] Int. Cl.[3] ..... B63B 21/24

[52] U.S. Cl. ..... 114/294

[58] Field of Search ..... 114/230, 293, 294, 304, 114/306; 9/8 R, 8 P, 8.3 R, 9; 405/26, 172, 224; 441/3

[56] References Cited

U.S. PATENT DOCUMENTS

| | | | |
|---|---|---|---|
| 102,584 | 5/1870 | Pattison | 114/306 |
| 3,404,652 | 10/1966 | Gardy | 114/297 |
| 3,579,182 | 5/1971 | Schneider | 114/304 |
| 3,757,727 | 9/1973 | Hungerford | 114/304 |
| 3,865,064 | 2/1975 | Van Heijst | 114/293 |
| 4,303,037 | 12/1981 | Helveston et al. | 441/3 |

FOREIGN PATENT DOCUMENTS

| | | | |
|---|---|---|---|
| 81345 | 8/1934 | Sweden | 9/8 R |
| 146774 | 7/1920 | United Kingdom | 114/230 |

*Primary Examiner*—S. D. Basinger
*Assistant Examiner*—Jesus D. Sotelo
*Attorney, Agent, or Firm*—Freilich, Hornbaker, Wasserman, Rosen & Fernandez

[57] ABSTRACT

A mooring system is provided, of the type that includes several chains extending in loose curves from a mooring buoy at the sea surface to spaced anchor locations at the seabed, which enables the buoy to deflect sidewardly by a further distance and to absorb more energy during such deflection than heretofor, particularly in shallow water mooring. The system includes an anchoring device which holds the lower end of a chain at a level raised high above the sea floor when the chain is pulled taut, while allowing the lower end portion of the chain to lie at a lower level such as at the sea floor when the chain is loose. One system includes an arm having an inner end pivotally mounted near the sea floor and an outer end connected to the lower end of the chain, so that tension in the chain pivots up the outer end of the arm to thereby raise the lower end of the chain.

2 Claims, 6 Drawing Figures

FIG. 4
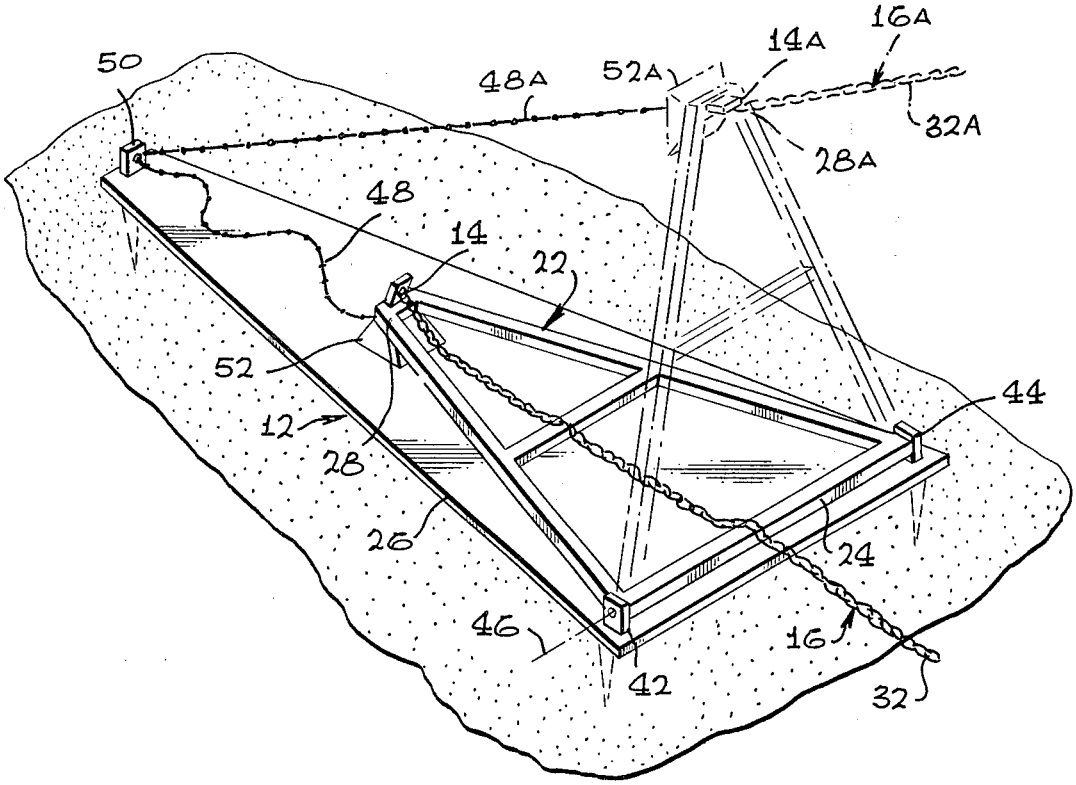
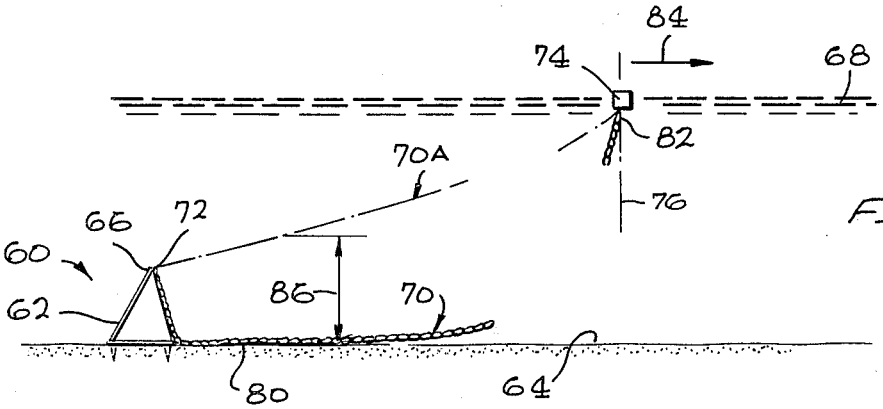
FIG. 5
FIG. 6
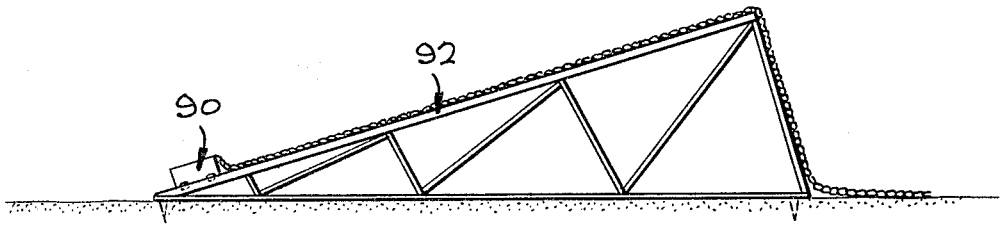

RAISED ANCHOR POINT CATENARY MOORING SYSTEM

BACKGROUND OF THE INVENTION

A CALM (catenary anchor leg mooring) system includes a buoy floating at the sea surface for connection to a vessel, and at least a few chains or lines extending in catenary curves from the buoy to locations spaced from one another on the seabed. Winds and currents that deflect the vessel and the buoy which holds it, cause one or more chains to be pulled more tautly while relieving tension in one or more other chains, to provide a restoring force that urges the buoy back to its initial quiescent position. While CALM systems operate effectively in deep waters, they can become ineffective in very shallow waters. In shallow waters, the chain which is pulled taut is not lifted much in average height, so that only a small amount of energy is available to restore the buoy to its initial position, and in addition the chain becomes taut after only a small buoy deflection. A mooring system of the CALM type which could operate even in relatively shallow waters to permit considerable buoy deflection and the application of large restoring forces through such deflection, would be of great value.

SUMMARY OF THE INVENTION

In accordance with one embodiment of the present invention, a mooring system is provided, of the type which includes a buoy at the sea surface which is held by a group of chains or other lines extending in loose curves to the sea surface, which enables the storage of increased amounts of energy. The system includes a device for anchoring the lower end of a line to the sea floor so that the lower end of the line is at a considerable height above the sea floor, at least when the line is pulled taut, while allowing the lower end portion of the line to lie near the sea floor when the line is loose. By holding the lower end of the line at a raised level, a long length of line along the lower end portion is raised a considerable height as the line is pulled taut, to thereby store energy which is released by returning the buoy to its initial position.

In one system, the device for anhcoring the lower end of the line includes an arm with an inner end pivotally connected through a base to the sea floor and an outer end which is connected to the lower end of the mooring line. Tension in the line causes the arm to pivot so that the outer end is raised when the line is under tension. The degree of arm pivoting is limited by a chain or the like which extends from the outer end of the arm to the base, so that when the anchor line tension is reduced the arm pivots down again. The pivoting of the arm not only raises the lower end of the anchor line, but also moves the anchor line in the direction of movement of the buoy, to permit longer buoy deflection. In another system, the lower end of the chain is held at the top of a rigid base which extends considerably above the sea bed.

The novel features of the invention are set forth with particularity in the appended claims. The invention will be best understood from the following description when read in conjunction with the accompanying drawings.

BRIEF DESCRIPTION OF THE DRAWINGS

FIG. 4 is a perspective view of a portion of the system of FIG. 3.

FIG. 5 is a partial side elevation view of a mooring system constructed in accordance with another embodiment of the invention.

FIG. 6 is a partial side elevation view of a mooring system constructed in accordance with another embodiment of the invention.

DESCRIPTION OF THE PREFERRED EMBODIMENT

Figure 1:
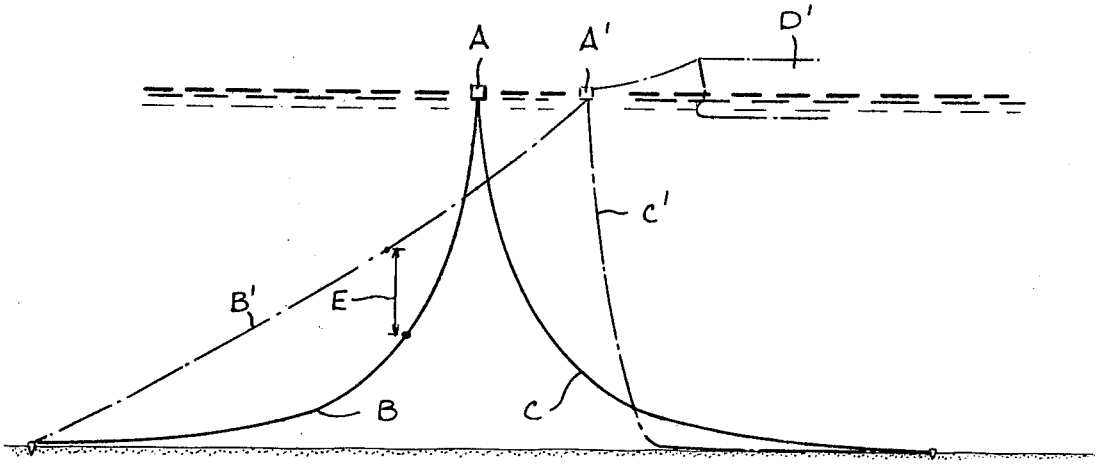
FIG. 1 PRIOR ART
FIG. 1 is a view of a prior art CALM system, showing how it operates during buoy deflection.

FIG. 1 shows a deep water CALM (catenary anchor leg mooring) system which includes a buoy A floating at the sea surface and held by several chains such as B and C extending in loose catenary curves to the sea bed. When a vessel that is moored to the buoy drifts to one side at D' the buoy deflects as to the position A', which results in one chain being pulled taut to the position B' while the other chain becomes even looser at the position C'. The average height of the chain B is raised by the distance E when it is pulled taut, and the potential energy resulting from the raising of the chain is utilized to restore the buoy to its initial position at A.

Figure 2:
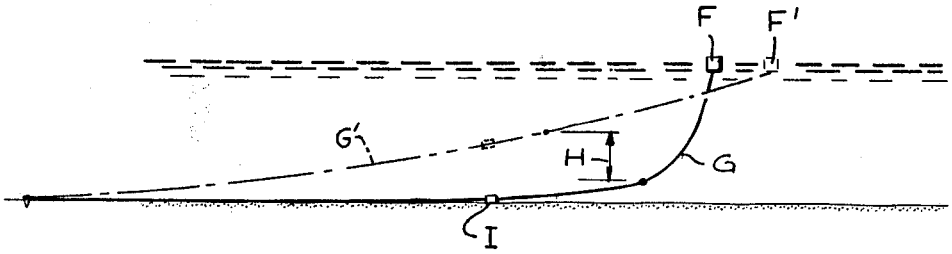
FIG. 2 PRIOR ART
FIG. 2 is a view of a CALM system similar to that of FIG. 1, but showing the operation in shallow water.

FIG. 2 shows a CALM system similar to that of FIG. 1, but utilized in a shallow sea area. When the buoy F deflects as to the position F', a chain G is pulled taut to the position G'. The shallow depth of the sea results in the disadvantage that the buoy can move laterally by only a small distance before the line becomes taut, and in the average height of the chain rising only a small distance H between the loose and taut positions. It may be noted that a clump weight I may be provided which lies on the sea bed when the chain is loose and is raised when the chain is pulled taut to increase the stored energy, although the clump weight also may be raised only a relatively small amount. The small deflection of the buoy F and the small amount of potential energy that is stored by pulling the chain taut, results in poor mooring characteristics. That is, where the buoy is moored by a hawser to a ship, the hawser will be pulled tight and break when only moderate forces are applied to the ship, even when those forces are of short duration and tend to move the ship only a small distance.

Figure 3:
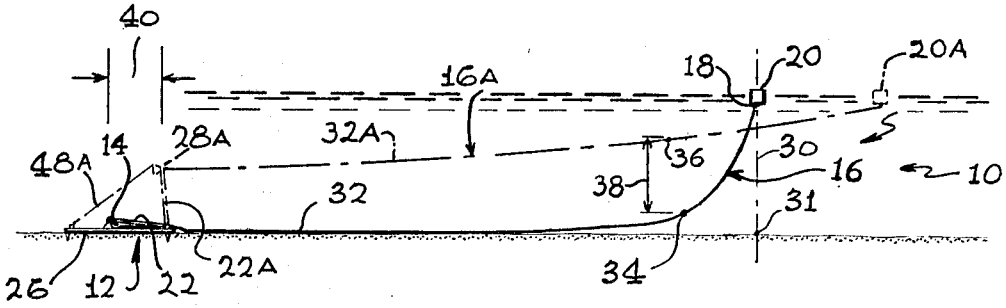
FIG. 3 is a partial side elevation view of a mooring system constructed in accordance with one embodiment of the present invention.

FIGS. 3 and 4 show a mooring system 10 constructed in accordance with the present invention, wherein an anchoring means or device 12 is provided for holding the lower end 14 of a mooring chain or line 16 whose upper end 18 is connected to a freely floating buoy 20 that can moor a ship as through a hawser or other device. The anchoring device 12 includes an arm 22 having an inner end 24 that is pivotally mounted on a base 26 that is, in turn, anchored to the sea floor. The arm 22 also has an outer end 28 that is connected to the lower end 14 of the anchor line 16. When the buoy 20 is in a neutral or quiescent position, wherein it lies on an axis 30, over a sea floor location 31, the line or chain 16 extends in a loose curve, with its lower end portion 32 lying at a low height as by resting directly on the sea floor. In this configuration, the anchor line 16 extends in the same manner as the anchor line G of the prior art of FIG. 2.

When the buoy deflects to the position 20A wherein the anchor chain is pulled taut to the position 16A, the tension in the anchor chain causes the arm 22 (FIG. 4) to pivot so that its outer end 38 is raised to the position 28A. This causes the lower end of the chain to be raised to the position 14A. As a result, the lower end portion 32 of the line is raised a large distance, to the position 32A, which is much more than the amount by which it would be raised if the lower end of the line remained at the position 14 instead of rising to 14A. The average height of the chain is therefore raised from the position 34 (FIG. 3) to the position 36, which is a vertical distance 38 that is much greater than the distance H by which the chain of FIG. 2 is raised when it is pulled taut. Furthermore, pivoting of the arm 22 to the position 22A results in the outer end of the arm moving horizontally by a distance 40.

The combination of the horizontal movement by the distance 40 of the lower end of the chain, and the raising of the height of the chain to position 16A results in the buoy moving a considerable distance between the positions 20 and 20A, which is much more than the movement permitted in the prior art system of FIG. 2. The combination of a greater lateral deflection of the buoy 20 before it is stopped by a taut chain, plus the much greater amount of potential energy that is stored by the raising of the chain, results in much more effective mooring of a ship when the system is utilized in shallow water.

FIG. 4 illustrates details of the anchor device 12 which holds the lower end 14 of the anchor line or chain. The base 26 which pivotally supports the arm 22, includes a pair of stanchions 42, 44 that pivotally support the inner end 24 of the arm to permit pivoting about a horizontal axis 46. The arm can pivot somewhat less than 90°, from a primarily horizontal position to a primarily vertical position by reason of tension in the anchor chain. A limit line member or line 48 is provided to limit the degree of pivoting of the arm to less than 90°, so that the arm will fall down to its initial horizontal position when anchor line tension is substantially removed. One end of the limit line is connected to a coupling 50 mounted at an end of the base 26 opposite the inner end of the arm, while the other end of the limit line is connected to the outer end 28 of the arm.

A weight 52 is mounted on the arm 22 near its outer end. The weight helps assure that the arm pivots down again when anchor chain tension is removed. In addition, the raising of the weight to the position 52A when the arm is pivoted up, results in the storing of additional energy. Although clump weights have been utilized along prior art anchor chains, the provision of the weight 52 on the pivoting arm, facilitates raising of the weight by a greater distance than is easily accomplished with a prior art clump weight. The rigid arm 22 does not sag as does a chain with a clump weight therealong, so that the weight 52 can be raised by a distance almost equal to the length of the arm when the arm is pivoted by almost 90° and the weight is located near the outer end of the arm. The lower end 14 of the line should lie above the sea floor even when the arm is pivoted down, to assure that tension in an almost horizontal chain will lift the arm. The arm should also be prevented from pivoting up so far that it may not reliably fall down when chain tension is removed, and the total arm pivoting may be about 70° between its lowered and raised positions.

The pivotal movement of the arm not only permits greater lateral movement of the buoy and the raising of the chain to a greater height, but also avoids the presence of a reef-hazard near the buoy except once in a while. That is, where the arm 22 has a considerable length so that a ship sailing over a raised arm could hit it, the fact that the arm is normally pivoted down results in avoiding this danger most of the time. Navigators directing ships through shallow water near the buoy 20 can take precautions to avoid moving the ship over the location of an anchoring device 12 of a mooring system when the buoy of the system holds a ship that is deflected considerably. In order to obtain significant advantages by the utilization of a pivoting arm, it is desirable that the arm be of considerable length compared to the depth of the sea directly under the neutral buoy position, with the arm preferably being more than 1/10th the depth of the sea thereat.

FIG. 5 illustrates an anchoring device or means 60 constructed in accordance with another embodiment of the invention, wherein the device 60 includes a fixed support 62 mounted on the sea floor 64 and having an upper end 66 lying far above the level of the sea floor, by a height of a plurality of meters, but below the sea surface 68. The anchor line or chain 70, whose upper end is connected to the buoy floating at the sea surface, has a lower end 72 which is connected to the upper end of the fixed support 62. When the buoy 74 lies at the quiescent position at 76, the anchor line 70 is loose enough so that a lower end portion 80 of the chain which lies a distance from the extreme lower end 72, lies on the sea bed 64. It may be noted that the term "lower end" 72 refers to the end of the chain opposite the upper end at 82, because the upper end is always higher than the lower end, and does not refer to the relative height of the lower end 72 with respect to a lower end portion 80 which includes a long length of line.

When the buoy 74 deflects in drift direction of arrow 84 until the anchor chain is taut as at 70A, the lower chain portion 80 is raised as by the distance 86, which is much more than would occur if the lower chain end 72 were lying at the sea floor. This increase in height of the lower chain portion results in the storage of potential energy which is utilized in returning the buoy to its quiescent position. However, the fixed chain support 72 does not permit much greater lateral deflection of the buoy (which is achieved by the pivoting arm mechanism of FIG. 3, when it moves by the horizontal distance 40 in pivoting up), although the fixed support 62 has the advantage of greater simplicity and does permit a small increase in lateral buoy deflection.

Thus, the invention provides an offshore mooring system of the CALM type wherein flexible chains or lines extending in loose curves anchor the buoy in approximate location while permitting some buoy deflection, which enables such a system ot be more effective in shallow water such as water less than about 100 meters in depth. This is accomplished by utilizing a means for anchoring the lower end of a line to the sea floor, which holds the lower end at a level raised above the sea floor when the line is pulled taut, while allowing the lower end portion of the line to lie at a lower level such as directly on the sea floor when the line is loose. This results in the lower end portion of the line being raised by a considerable level when the line is pulled taut, to thereby store considerable potential energy for returning the buoy to its initial position. A fixed anchoring device can be utilized which holds the lower end of the line at a constant level above the sea floor, which is preferably a plurality of meters above the sea floor, to gain significant increase in potential energy storage when the chain is pulled taut. Another anchoring means can be formed by an arm having an inner end pivotally mounted near the sea floor and an outer end which can pivot up and which is connected to the lower end of the chain. The later system has the additional advantages of moving the lower end of the chain in the direction of buoy deflection, to permit a greater buoy deflection, while also avoiding a reef-like danger to ships when the buoy is not deflected and the arm is pivoted down. A variety of other embodiments of the invention can be utilized, such as that shown in FIG. 6 wherein a carriage 90 near the sea bottom is connected to the lower end of the line and runs along an incline track 92 by rolling or sliding therealong. In any case, the increased mooring ability of systems of the invention which hold the end of the mooring line at a height raised considerably above the sea floor when the line is pulled taut, provide considerably enhanced mooring ability particularly in shallow waters, for which there has been a considerable need.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. An offshore mooring system for use in a sea, comprising:

a member to be anchored having a portion substantially at the sea surface;

a plurality of chain devices extending in loose curves from said member portion to the sea bed;

a plurality of anchoring devices, each having a base mounted on the sea floor and a substantially rigid arm having an inner end pivotally mounted on the base about a largely horizontal axis and an outer end connected to an end of one of said chain devices, said outer end of said arm lying on a side of said axis which is opposite said member; and a limit line extending between locations on said base and said arm which are each spaced from the axis of pivoting of said arm on said base, to prevent pivoting of the arm by more than a limited angle from the horizontal.

2. The system described in claim 1 wherein: said limited angle from the horizontal is less than 90° but more than 45°.

* * * * *